US005535766A

United States Patent [19]

Edwards

[11] Patent Number: 5,535,766

[45] Date of Patent: Jul. 16, 1996

[54] TRANSMISSION SERVICE BENCH

[76] Inventor: David L. Edwards, 4287 Frantz Ave., NE., Louisville, Ohio 44641

[21] Appl. No.: 391,410

[22] Filed: Feb. 16, 1995

[51] Int. Cl.[6] ..... B08B 3/00

[52] U.S. Cl. ..... 134/60; 134/88; 134/104.1; 134/104.3; 134/111; 134/113; 134/186; 134/191; 134/198

[58] Field of Search ..... 134/60, 88, 89, 134/90, 91, 84, 104.1, 104.3, 111, 186, 191, 198, 199, 113, 115 R

[56] References Cited

U.S. PATENT DOCUMENTS

| | | | |
|---|---|---|---|
| 214,271 | 4/1879 | Zundorff . | |
| D. 306,100 | 2/1990 | Wende . | |
| 1,587,213 | 6/1926 | Brown | 134/60 X |
| 1,691,839 | 11/1928 | Caskin | 134/60 |
| 2,262,767 | 11/1941 | Jeter . | |
| 2,352,356 | 6/1944 | Albertson | 134/111 |
| 2,972,506 | 2/1961 | Haag . | |
| 3,334,567 | 8/1967 | Benson | 134/198 |
| 3,343,555 | 9/1967 | Kasner | 134/60 X |
| 4,501,202 | 2/1985 | Corazza . | |
| 4,637,413 | 1/1987 | Llewellyn et al. | 134/111 |
| 4,934,280 | 6/1990 | Bae . | |
| 5,336,125 | 8/1994 | Despointes . | |
| 5,368,653 | 11/1994 | Russell | 134/111 X |
| 5,401,328 | 3/1995 | Schmitz | 134/111 X |

FOREIGN PATENT DOCUMENTS

| | | | |
|---|---|---|---|
| 2029258 | 10/1970 | France | 134/60 |
| 899045 | 6/1962 | United Kingdom | 134/89 |

*Primary Examiner*—Philip R. Coe
*Attorney, Agent, or Firm*—Oldham & Oldham Co.

[57] ABSTRACT

The present invention relates to a transmission service bench having an inclined work surface to direct transmission fluid, liberated from a transmission being serviced, into one or more drains. The fluid collected is filtered and communicated to a wash basin provided adjacent to the work surface. The fluid contained in the wash basin may be used alone or combined with a cleaning solvent to clean various transmission components. A pump is included for providing a pressurized stream of fluid to be used for cleaning individual transmission components and/or for pumping fluid from the wash basin onto the work surface to flush din and debris therefrom. The wash basin may include a lid that closes automatically should a fire occur in or near the wash basin.

10 Claims, 3 Drawing Sheets

TRANSMISSION SERVICE BENCH

FIELD OF INVENTION

This invention relates generally to work benches and more particularly to a work bench designed to facilitate the disassembly, reassembly, and repair of motor vehicle transmissions and other motor vehicle drivetrain subassemblies such as a differentials and four-wheel drive transfer cases.

BACKGROUND OF THE INVENTION

The disassembly, repair, and/or reassembly of a motor vehicle transmission can be a difficult task, involving numerous complex interrelated components. Typically, one must open the transmission case, collect the transmission fluid liberated therefrom, disassemble the internal components, clean all of the components, replace the defective components, and reassemble the transmission. The transmission fluid or oil is oftentimes dirty and may be hazardous and/or caustic to those coming in frequent contact therewith. If spilled on the shop floor, it creates a slippery condition hazardous to those walking about. Also, this fluid, and the cleaning solvents used may be highly inflammable.

In disassembling, cleaning, repairing, and/or reassembling a vehicle transmission, one must be certain not to misplace any of the numerous components of the transmission. One must also have ready access to a variety of tools and other supplies such as rags, and cleaning solutions. Also, one must be provided with a well lighted work environment. Finally, there has been found a need to provide a transmission work bench that is capable of being easily moved from one place to another within a work shop. Typically however, transmissions and other fluid containing automotive subassemblies are repaired on the floor of the work area or on conventional multi-purpose work benches unsuited for the collection of liberated fluids.

SUMMARY OF THE INVENTION

The present invention is therefore directed to a transmission service bench comprising a work surface wherein at least a portion thereof is inclined such that fluid introduced onto the work surface flows from a point of higher elevation on the work surface to a point of lower elevation on the work surface; drain means for collecting fluid introduced onto the work surface; a base, including at least one caster for supporting the work surface; a wash basin for cleaning components of a transmission; and, a pump, including at least one fluid outlet, designed to pump fluid from the wash basin through the fluid outlet onto the work surface.

One or more troughs may be provided to function as the drain means for collecting fluid. The fluid collected in the one or more troughs is preferably directed into the wash basin where it may be used alone or combined with a cleaning solvent to clean the various components of the transmission. Alternatively, the wash basin may be provided with two separate fluid containing areas, one for the collected transmission fluid, and a second for a cleaning solvent such as mineral spirits.

The pump may also be provided with a second fluid outlet in the form of a flexible nozzle which may be utilized to spray the cleaning fluid onto the various transmission components. A wash rack may also be provided in the wash basin for facilitating the cleaning process. The wash basin preferably includes a lid that may be closed as desired and which may also be provided with an emergency closure means for automatically closing the lid should a fire occur in or near the wash basin.

The base for supporting the work surface preferably includes legs and one or more wheels and/or casters for allowing the transmission service bench to be easily moved as desired. The base may optionally include brake means for preventing any unwanted movement of the work bench once it is located as desired.

The work bench can also be modified to include various drawers, shelves, and other means for storing tools, parts, rags, or any other supplies that may be necessary for assembling or disassembling a vehicle transmission. Also, a light may be provided for properly illuminating the work being performed.

DETAILED DESCRIPTION OF THE INVENTION

Figure 1:
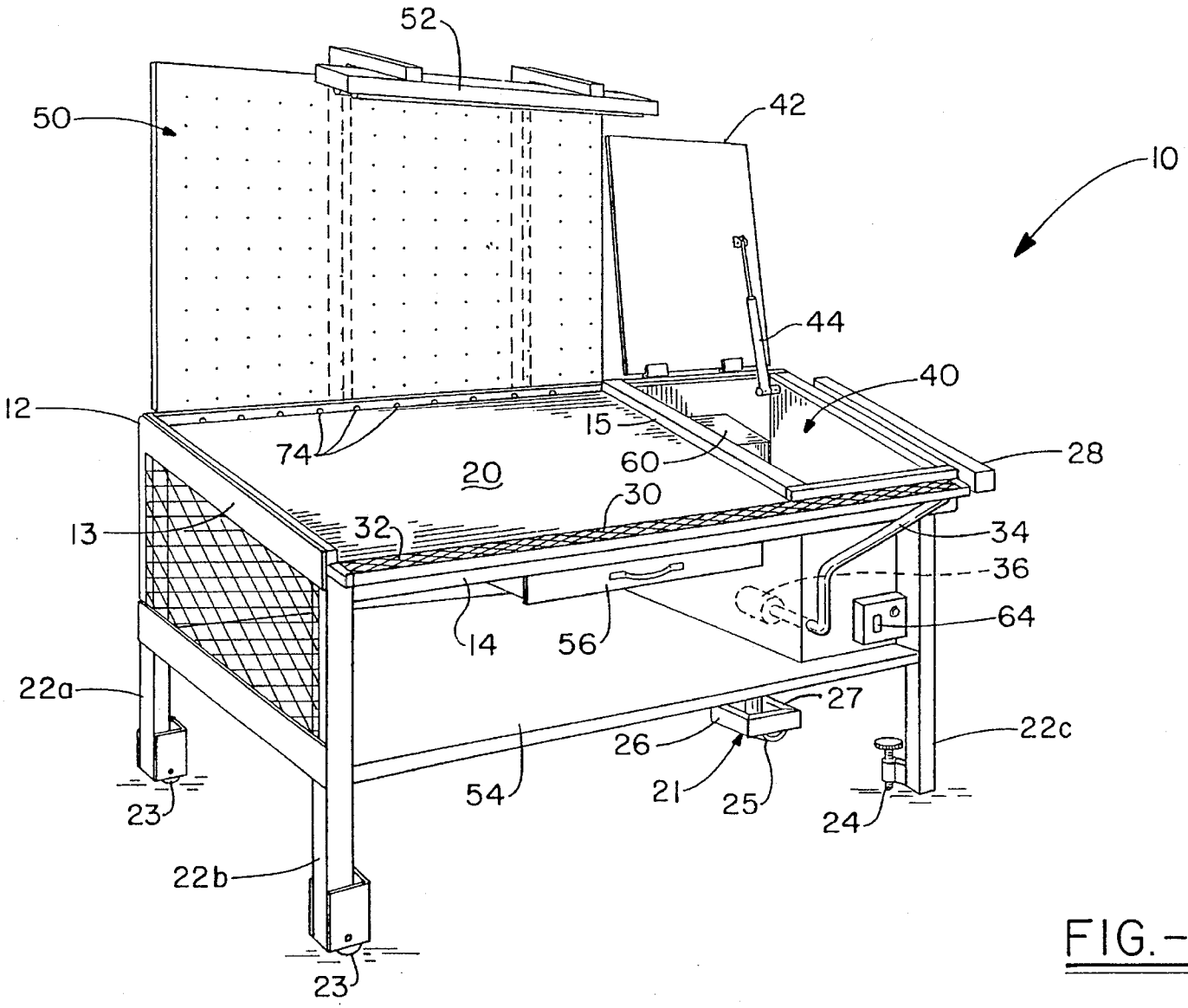
FIG. 1 is a perspective view of a preferred embodiment of the present invention.

Reference will now be made in detail to the preferred embodiments of the invention, examples of which are illustrated in the accompanying drawings. Wherever possible, the same reference numerals will be used throughout the drawings to refer to the same or like parts.

Figure 2:
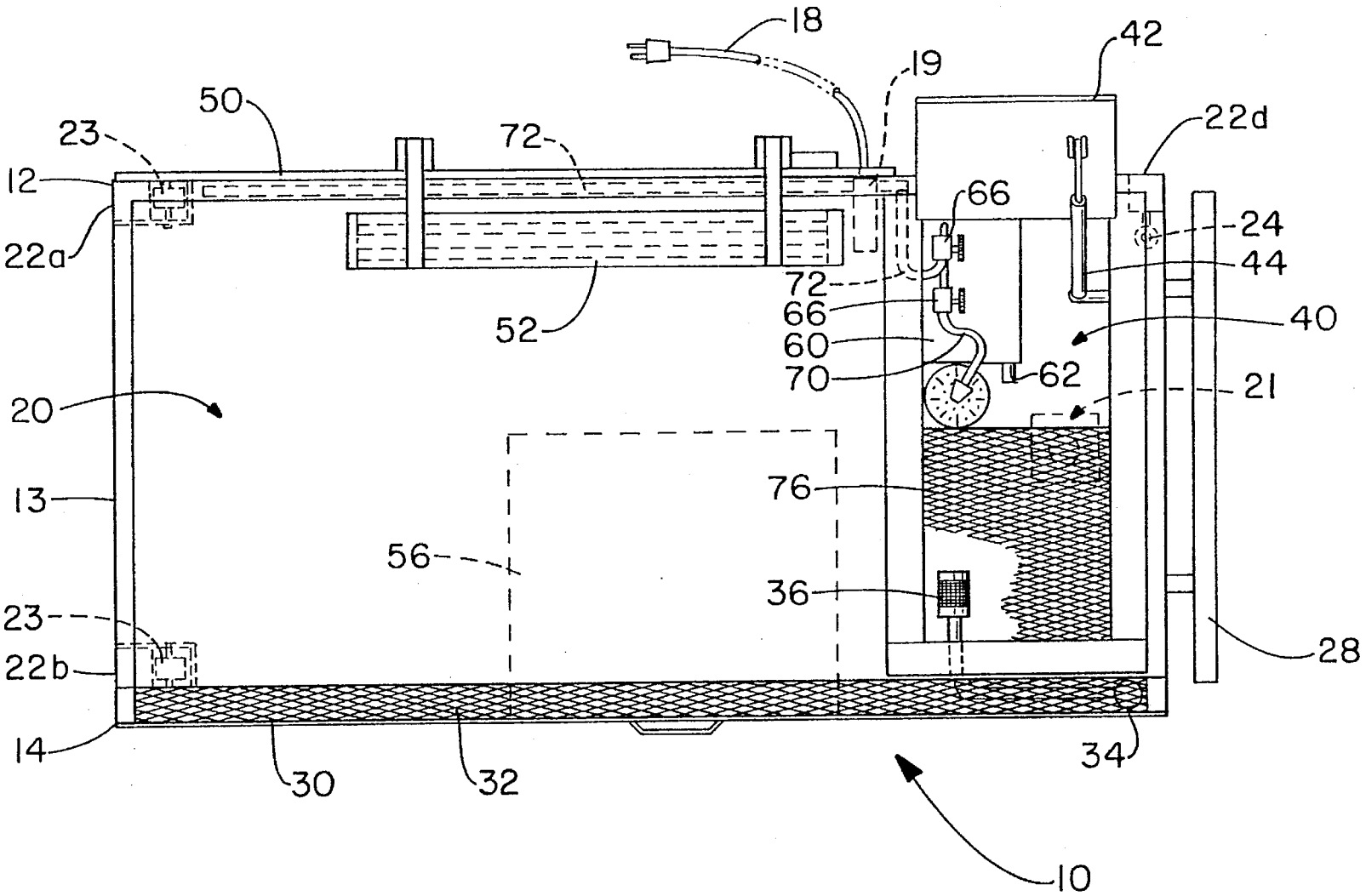
FIG. 2 is a top plan view of the embodiment shown in FIG. 1.

The preferred embodiment of the transmission service bench of the present invention is shown generally at 10 in FIG. 1 and comprises a work surface 20 supported by legs 22*a*, 22*b*, 22*c*,22*d*, and a caster assembly 21. At least two of legs 22*a–d* preferably include wheels 23 to operate in conjunction with caster 21 allowing the service bench 10 to be moved. One or more legs 22*a–d* may include leveling means for adjusting the positioning of the leg 22*a–d* to which it is attached. For example as seen in FIGS. 1 and 2, legs 22*c*,22*d* each include a leveling screw 24 that is threadably secured to legs 22*c*,22*d*. Rotation of leveling screw 24 causes leg 22*c*,22*d* to be lengthened or shortened depending upon the direction in which leveling screw 24 is rotated. Work surface 20, legs 22*a–d*, and other components of bench 10 are preferably made of steel or a similar metal although any other suitable material may be utilized. In the preferred embodiment, caster 21 is designed such that when the table is at rest, caster 21 is not in contact with the shop floor, and service bench 10 is supported on legs 22*a–d*. Caster 21 preferably includes air pump 27 or other suitable means for selectively extending caster wheel 25 from base 26 such that caster wheel 25 and wheels 23 are supporting the weight of service bench 10. In this manner, bench 10 may be easily moved. Once located where desired, the pump 27 is depressurized such that wheel 25 retracts into base 26 allowing legs 22*a–d* to once again rest on the shop floor. A handle 28 may also be connected to service bench 10 to facilitate the moving of service bench 10.

Figure 3:
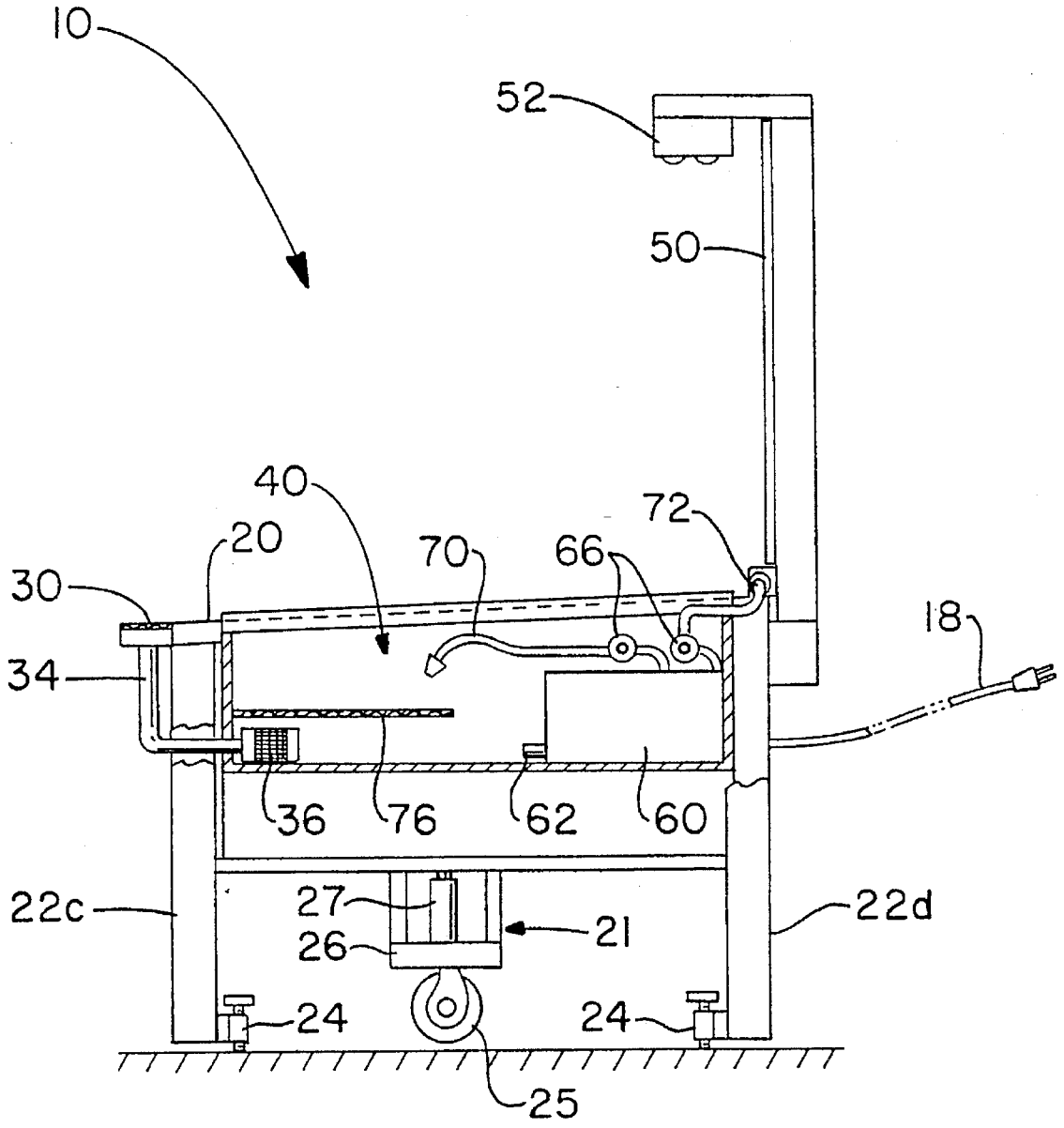
FIG. 3 is a partially broken away, side elevational view of the embodiment shown in FIG. 1.

Work surface 20, as may be more clearly seen in FIG. 3, is at least substantially planar and is inclined downward from the rear 12 of service bench 10 to the front 14. For example, a vertical drop of 1" from the rear edge 12 to the front edge 14 of service bench 10 is thought to be a suitable grade for work surface 20. When fluid is introduced onto work surface 20, such as may occur when a transmission is disassembled on work surface 20, inclined work surface 20 causes the fluid to flow toward the front 14 of service bench 10. A drainage trough 30 or other suitable means for draining fluid from work surface 20 is provided along at least a portion of front 14 of service bench 10 adjacent to work surface 20 to collect any fluid flowing across work surface 20. Trough 30 preferably contains a screen or mesh covering 32 to prevent the passage of relatively large contaminants or transmission components into trough 30. It will be recognized that depending upon the configuration of the inclined work surface 20, trough 30 or a plurality of separate troughs may be provided in other suitable locations to collect fluid. For example, work surface 20 may alternatively be inclined from the left edge 13 to the right edge 15 of service bench 10, vice versa, or inclined from front edge 14 to rear edge 12. In such an embodiment, a trough may be provided along at least a portion of the appropriate lower edge of work surface 20 to collect the fluid flowing across work surface 20. In still a further embodiment, work surface 20 may be configured such that fluid found on the surface thereof is caused to flow toward the center or other location of work surface 20. A trough or drain may be provided at this location to collect the fluid flowing across the work surface 20.

A wash basin 40 is preferably provided adjacent to at least one side 13,15 of work surface 20. Wash basin 40 is designed to contain a quantity of transmission fluid and/or cleaning solvent to provide a cleaning solution that may be utilized to clean components removed from a transmission undergoing service. Service bench 10 may also include a transmission fluid reservoir and/or a separate cleaning solvent reservoir to provide convenient access to these fluids as they may be needed. Wash basin 40 may be designed simply to contain a quantity of cleaning solution, or trough 30 may be connected by a pipe 34 or otherwise configured to be in fluid communication with wash basin 40 such that fluid entering trough 30 flows in to wash basin 40. Pipe 34 is preferably provided with a filter 36 to filter at least some of the contaminants from the fluid before it flows into the wash basin 40. Filter 36 is preferably removable or otherwise capable of periodic cleaning. In an alternative embodiment, wash basin may be divided into two separate fluid containing areas or basins. In such an embodiment, one fluid containing area or basin would be designed to contain the collected transmission fluid, while the second fluid containing area or basin would be designed to contain a cleaning solvent.

Wash basin 40 preferably contains a means for pumping the cleaning solution and/or transmission fluid to other locations as may be desired. In the preferred embodiment, an electric submergible pump 60 provides the means for pumping the transmission fluid or cleaning solution for uses described hereinbelow. Pump 60 includes an inlet 62 through which the cleaning solution enters the pump 60. Pump 60 is preferably configured with a flexible hose 70 as an outlet for the cleaning solution being pumped. Flexible hose 70 is preferably sufficiently rigid that it will hold a position into which it is bent. Flexible hose 70 may be used by one servicing a transmission to direct a pressurized flow of cleaning solution as desired. At least one removable rack 76, preferably made of a screen or mesh, is provided within wash basin 40 and functions as a suitable place upon which to place the transmission parts being cleaned. Flexible hose 70 may be utilized to direct a pressurized flow of cleaning solution onto one or more parts placed on rack 76.

Pump 60 is also preferably provided with a second outlet into pipe 72. Pipe 72 is oriented along the upper edge of work surface 20 and contains a plurality of holes 74 therein along that portion of pipe 72 extending along the upper edge of work surface 20. When cleaning solution or transmission fluid is pumped by pump 60 into pipe 72, cleaning solution and/or transmission fluid will flow from holes 74 and across inclined work surface 20 into trough 30. In this manner, work surface 20 may be flushed of dirt and debris. One or more valves 66 are preferably provided in conjunction with pump 60, flexible hose 70, and pipe 72 to allow one using the service bench 10 to control the flow of fluid. Valves 66 may be used to direct the flow of fluid through either flexible hose 70, pipe 72, or both. An on/off switch 64 is also provided to control the operation of pump 60.

Wash basin 40 is provided with a lid 42 that may be closed when the wash basin 40 is not being used, or for example, when service bench 10 is being moved. In a preferred embodiment, lid 42 is also provided with means for automatically closing the lid to cover wash basin 40 upon the occurrence of excessive heat in the region of wash basin 40 as may occur during a fire in or near wash basin 40. For example a heat sensitive pneumatic or hydraulic cylinder 44 may be connected to lid 42 at one end and to wall of wash basin 40 or other location of service bench 10 at its other end. Upon the occurrence of the threshold value of heat in the region of wash basin 40, the seals inside cylinder 44 deteriorate causing the lid 42 to close and cover wash basin 40 due to the force of gravity or other force that may exist such as spring-loaded hinges.

Service bench 10 is also provided with a tool storage board 50 such as a peg board including a plurality of holes into which fit a variety of implements for securing tools adjacent to the board. A light 52 is also preferably provided to ensure that work surface 20 and wash basin 40 are well-lit. An additional storage shelf 54 and/or a drawer 56 may also be provided beneath work surface 20 or in other locations to provide additional storage space for tools, replacement parts, and any other supplies as desired.

An electrical cord 18 is provided and may be stored on a spring loaded coil 19 or similar storage mechanism allowing cord 18 to be extended to any length desired, and allowing cord 18 to be conveniently and easily retracted and stored when not in use. Cord 18 provides a means for providing electrical service to the service bench 10 as may be required to power pump 60, light 52, and any other electrical devices provided.

Although the foregoing description has set forth the preferred embodiment of the invention in particular detail, it must be understood that numerous modifications, substitutions, and changes may be undertaken without departing from the true spirit and scope of the present invention as defined by the ensuing claims.

What is claimed is:

1. A transmission service bench comprising:

a work surface wherein at least a portion of said work surface is inclined such that fluid introduced onto said inclined portion of said work surface flows from a point of higher elevation on said surface to a point of lower elevation on said surface;

at least one drain trough for collecting fluid introduced onto said work surface, said at least one trough provided along at least a portion of an edge of said inclined work surface;

a plurality of legs, connected to said work surface and depending therefrom for supporting said work surface above a floor;

at least one caster assembly connected to said service bench, said at least one caster assembly including a base and a wheel, wherein said caster assembly wheel is selectively operable to movably support said transmission service bench relative to said floor on at least said caster assembly wheel;

an open wash basin positioned adjacent to said work surface in which transmission components may be cleaned;

means for communicating fluid from said at least one drain trough to said open wash basin;

a pump in fluid communication with said wash basin including at least one fluid outlet pipe extending from an outlet of said pump to a position adjacent to at least a portion of said work surface and including a plurality of outlet holes therein to communicate fluid from said wash basin onto said work surface.

2. A transmission service bench as recited in claim 1, wherein said at least one trough is open and a screen is provided across said at least one open trough to prevent unintended materials from entering said at least one trough.

3. A transmission service bench as recited in claim 1, wherein said means for communicating fluid from said at least one trough to said wash basin is a pipe, and wherein said transmission service bench further comprises a filter releasably connected to said pipe for filtering contaminants from said fluid flowing between said at least one trough and said wash basin.

4. A transmission service bench as recited in claim 1, wherein said pump means further comprises a flexible outlet hose in fluid communication with a fluid outlet of said pump for directing a pressurized flow of fluid from said wash basin through said flexible outlet hose.

5. A transmission bench as recited in claim 4, further comprising a valve for controlling the flow of fluid to said at least one fluid outlet pipe and said flexible fluid outlet hose.

6. A transmission service bench as recited in claim 1, further comprising a lid for selectively covering said wash basin and a heat sensitive fluid cylinder connected between said lid and said wash basin, whereby said heat sensitive fluid cylinder allows said lid to close and cover said wash basin under the force of gravity when said heat sensitive cylinder is exposed to a threshold value of heat.

7. A transmission service bench as recited in claim 1, further comprising a tool storage board extending upward from a rear edge of said work surface, said tool storage board including means for releasably retaining tools adjacent thereto.

8. A transmission service bench as recited in claim 1, further comprising a light source positioned over said work surface for illuminating said work surface.

9. A transmission service bench as recited in claim 1, further comprising a storage drawer positioned beneath said work surface.

10. A transmission service bench as recited in claim 1, wherein said wheel of said at least one caster assembly is selectively extensible from said base and selectively retractable into said base of said at least one caster assembly, such that said transmission service bench is movably supported on at least said wheel relative to a floor when said wheel is extended relative to said base and said transmission service bench is immovably supported relative to said floor on said plurality of legs when said wheel is retracted into said base.

* * * * *